US008979296B2

(12) United States Patent
Wiemer et al.

(10) Patent No.: US 8,979,296 B2
(45) Date of Patent: Mar. 17, 2015

(54) ILLUMINATED SHELVING

(75) Inventors: Jim Wiemer, Fox Point, WI (US); Ryan Brobt, Grafton, WI (US); Jan Pergande, Cedarburg, WI (US)

(73) Assignee: DCI Marketing, Inc., Milwaukee, WI (US)

( * ) Notice: Subject to any disclaimer, the term of this patent is extended or adjusted under 35 U.S.C. 154(b) by 0 days.

(21) Appl. No.: 13/415,138

(22) Filed: Mar. 8, 2012

(65) Prior Publication Data

US 2012/0230018 A1 Sep. 13, 2012

Related U.S. Application Data

(60) Provisional application No. 61/450,420, filed on Mar. 8, 2011.

(51) Int. Cl.

| | |
|---|---|
| ***A41F 11/10*** | (2006.01) |
| ***A47F 5/10*** | (2006.01) |
| ***A47F 11/10*** | (2006.01) |
| ***F21V 33/00*** | (2006.01) |

(52) U.S. Cl.

CPC ..... *A47F 5/103* (2013.01); *A47F 11/10* (2013.01); *F21V 33/0012* (2013.01)

USPC ..... 362/125; 362/92

(58) Field of Classification Search

USPC ..... 362/133, 125, 147, 92

See application file for complete search history.

(56) References Cited

U.S. PATENT DOCUMENTS

| | | | | |
|---|---|---|---|---|
| 4,689,726 | A * | 8/1987 | Kretzschmar | 362/127 |
| 4,747,025 | A | 5/1988 | Barton | |
| 4,973,796 | A | 11/1990 | Dougherty | |
| 5,022,720 | A * | 6/1991 | Fevig et al. | 312/223.5 |
| 5,205,638 | A * | 4/1993 | Squitieri | 362/125 |
| 5,425,648 | A | 6/1995 | Farham | |
| 5,915,824 | A | 6/1999 | Straat | |
| 6,231,205 | B1 | 5/2001 | Slesinger et al. | |
| 6,276,810 | B1 | 8/2001 | Vosshenrich | |
| 6,283,608 | B1 | 9/2001 | Straat | |
| 6,918,679 | B2 | 7/2005 | Wu | |
| 7,163,305 | B2 | 1/2007 | Bienick | |
| 7,614,350 | B2 | 11/2009 | Tuttle | |
| 2008/0055914 | A1 * | 3/2008 | O'Rourke | 362/368 |
| 2008/0083353 | A1 | 4/2008 | Tuttle et al. | |
| 2008/0278932 | A1 * | 11/2008 | Tress | 362/133 |
| 2011/0044030 | A1 | 2/2011 | Pichel | |

(Continued)

FOREIGN PATENT DOCUMENTS

| | | |
|---|---|---|
| DE | 20111800 | 11/2001 |
| DE | 102010050500 | 5/2012 |
| EP | 0683998 | 11/1995 |

(Continued)

OTHER PUBLICATIONS

International Search Report issued for PCT/US12/28250; mailed Mar. 8, 2012.

(Continued)

*Primary Examiner* — Julie Bannan

(74) *Attorney, Agent, or Firm* — Fitch, Even, Tabin & Flannery LLP

(57) ABSTRACT

An illuminated shelving system is provided having light bars attached to the shelves. The light bars are electrically connected to a power strip that conducts electricity from a wall outlet to a plurality of light bars.

19 Claims, 4 Drawing Sheets

(56) References Cited

U.S. PATENT DOCUMENTS

| | | | |
|---|---|---|---|
| 2011/0204009 | A1 | 8/2011 | Karan |
| 2013/0299439 | A1 | 11/2013 | Sid |

FOREIGN PATENT DOCUMENTS

| | | |
|---|---|---|
| EP | 2220965 | 8/2010 |
| EP | 2292120 | 3/2011 |
| GB | 2291788 | 2/1996 |
| GB | 2297896 | 8/1996 |
| GB | 235148 | 11/1998 |
| GB | 2359405 | 8/2001 |
| WO | 2006067396 | 6/2006 |
| WO | 2012009822 | 1/2012 |

OTHER PUBLICATIONS

International Search Report issued in International Application No. PCT/US12/28250, mailed Jul. 5, 2012 1 p. (beign resubmitted due to error in previously-cited date).

* cited by examiner

ILLUMINATED SHELVING

CROSS-REFERENCE TO RELATED APPLICATION

This application is based on and claims priority to U.S. Provisional Patent Application No. 61/450,420 filed on Mar. 8, 2011, which is incorporated herein by reference in its entirety for all purposes.

FIELD OF THE INVENTION

The present invention relates generally to the field of display shelving. More particularly, the present invention relates to a shelving system that incorporates low voltage light fixtures attached to one or more shelves.

BACKGROUND

In the retail environment, it is common for merchandise to be displayed on a series of adjustable shelves. Retail display shelving falls into two basic categories: (1) cases where shelves are supported by pins inserted into holes on each side of the case or (2) wall displays where a number of vertically oriented, slotted standards are attached to a wall and brackets having hooks designed to engage the slots support the shelves.

It is desirable to present the merchandise displayed on the shelves in a way that is attractive and easily visible to a potential customer. One way to increase the visibility of merchandise is to provide adequate lighting. In many retail environments, the primary source of lighting is provided by ceiling mounted fixtures. Specific products may also be highlighted or accented through the use of spot lights. When non-illuminated shelving is used, the upper shelves cast shadows that result in less than optimal lighting for the lower shelves.

There have been previous attempts to create shelving systems with integrated lighting, but those solutions present a number of shortcomings that the present invention seeks to address. Many such shelving systems essentially mounted existing light fixtures to the bottoms of already existing shelves. Such a solution presented the problem that each light fixture had a conventional plug that needed to be plugged into an outlet. For a system with fixed shelves, or shelves with a limited range of adjustment, the power cords could be relatively easily hidden. If the shelving has a broader range of adjustment, it is necessary to provide excess power cord, which is more difficult to hide.

As such, there is a need for a retail shelving system that incorporates lighting into the shelves such that the shelves may be quickly, easily, and safely reconfigured.

SUMMARY OF THE INVENTION

The present invention relates to an illuminated shelving system with integrated lighting for displaying items. The illuminated shelving system includes at least one shelf that is removably attached to a shelf support that supports the shelf in a horizontal position. The shelf support further includes a power strip to which the plug is removably attached and which provides electrical power to the light bar. At least one light bar is attached to at least one of the shelves and includes a power cable. An electrical plug is attached to the free end of the power cable. Each shelf includes a channel that encloses the power cable.

It will be understood by those skilled in the art that one or more aspects of this invention can meet certain objectives, while one or more other aspects can lead to certain other objectives. Other objects, features, benefits and advantages of the present invention will be apparent in this summary and descriptions of the disclosed embodiment, and will be readily apparent to those skilled in the art. Such objects, features, benefits and advantages will be apparent from the above as taken in conjunction with the accompanying figures and all reasonable inferences to be drawn therefrom.

DETAILED DESCRIPTION

Figure 1:
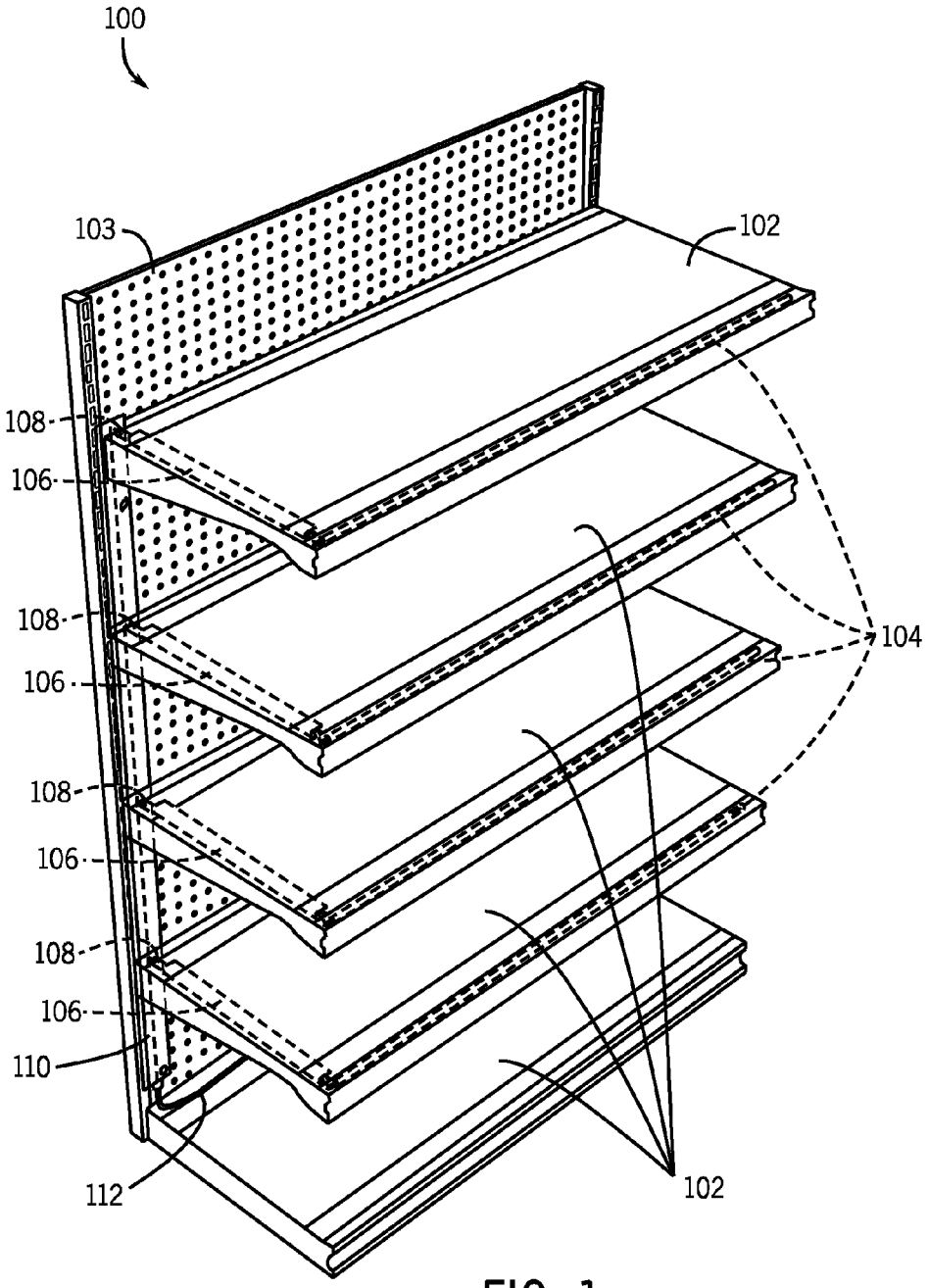
FIG. 1 is a front perspective view of one embodiment of an illuminated shelving system in accordance with the invention.

FIG. 1 is a perspective view of one embodiment of an illuminated shelving system in accordance with the invention. The shelving system 100 includes shelves 102 attached to a shelf support 103, light strips 104, light strip power cords 105, cord channels 106, and plugs 108 that connect to a power strip 110 that, in turn, is connected to a power source by a power cord 112. As shown, the shelves 102 are removably attached to the shelf support 103 and may be adjusted as required by the retailer to provide the proper spacing for displaying products. The light strips 104 are array of light emitting diodes (LED), but other lighting technologies such as halogen, fluorescent, or incandescent lamps may also be used without departing from the present invention. The light strips 104 may provide continuous brightness across the light strip, or may be configured to illuminate only certain portions of the shelf. Such a configuration allows the light strips 104 to provide accent lighting if so desired.

The light strips 104 are removably attached to the bottom surface of as many of the shelves 102 as is desired. The light strips 104 may be attached to the shelf 102 by adhesive, hook and loop fastener, bracket, or other attachment means. Each light strip 104 may be removably attached to the power strip 110.

Figure 2:
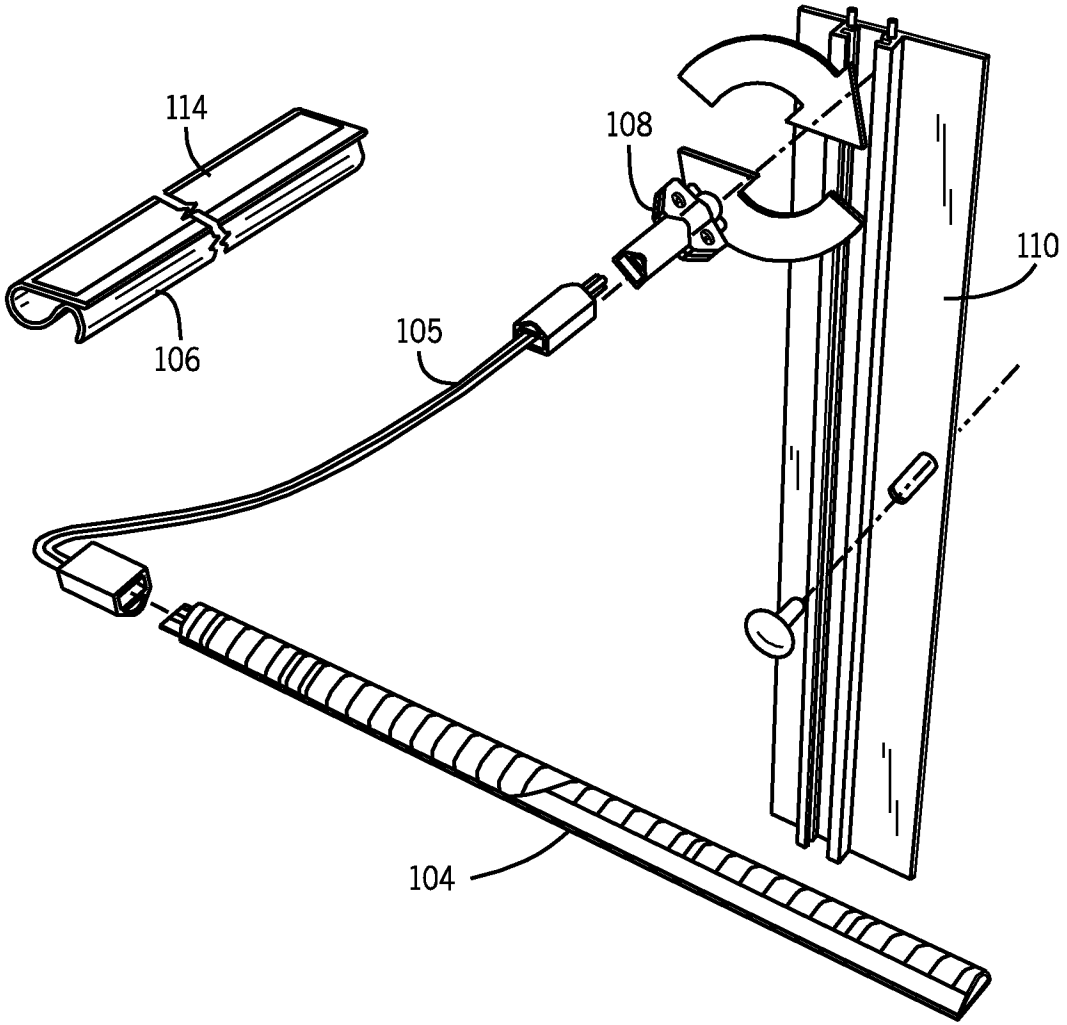
FIG. 2 is a perspective view of the illumination components of the shelving system of FIG. 1.
Figure 3:
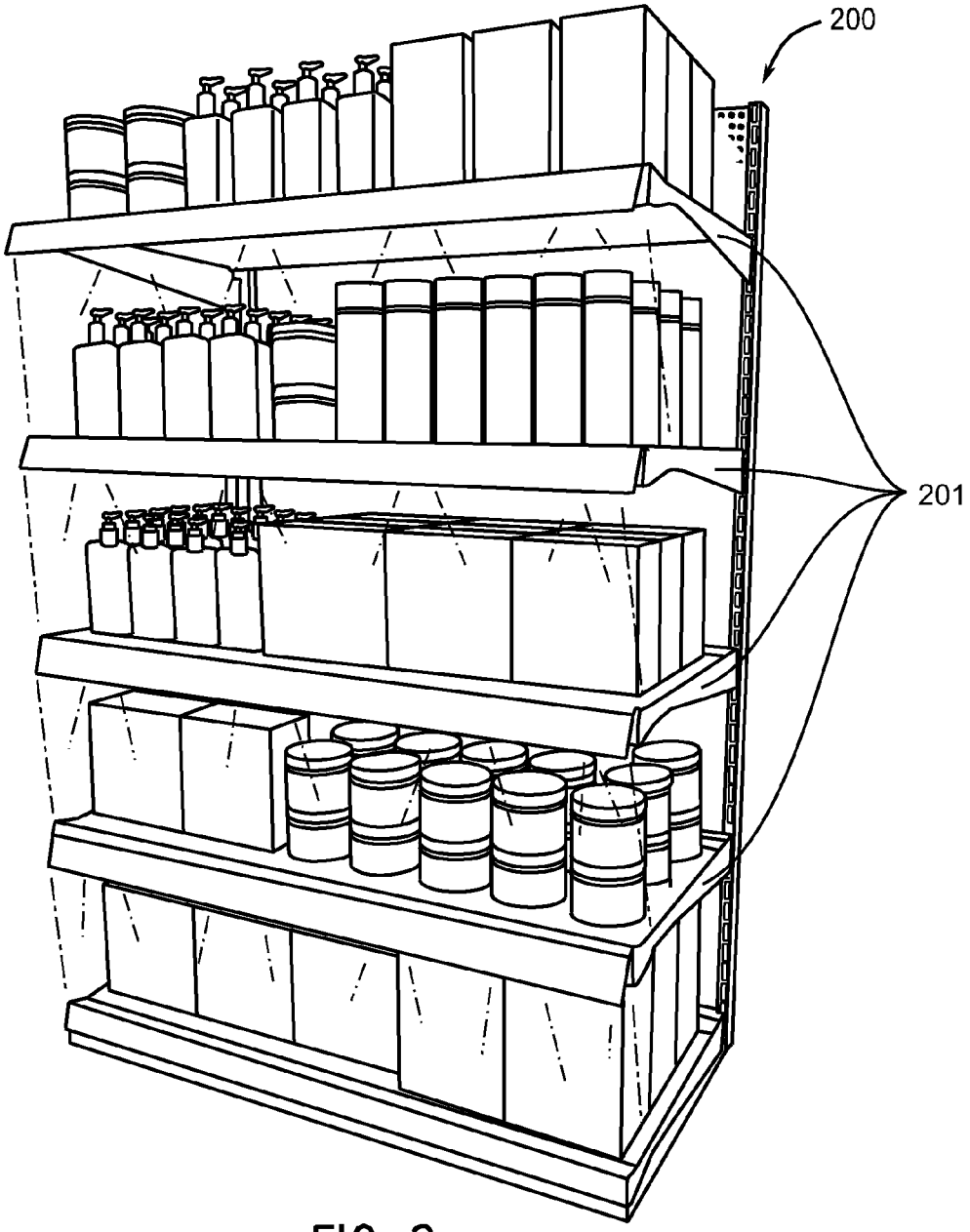
FIG. 3 is a perspective view of another embodiment of an illuminated shelving system in accordance with the invention.
Figure 4:
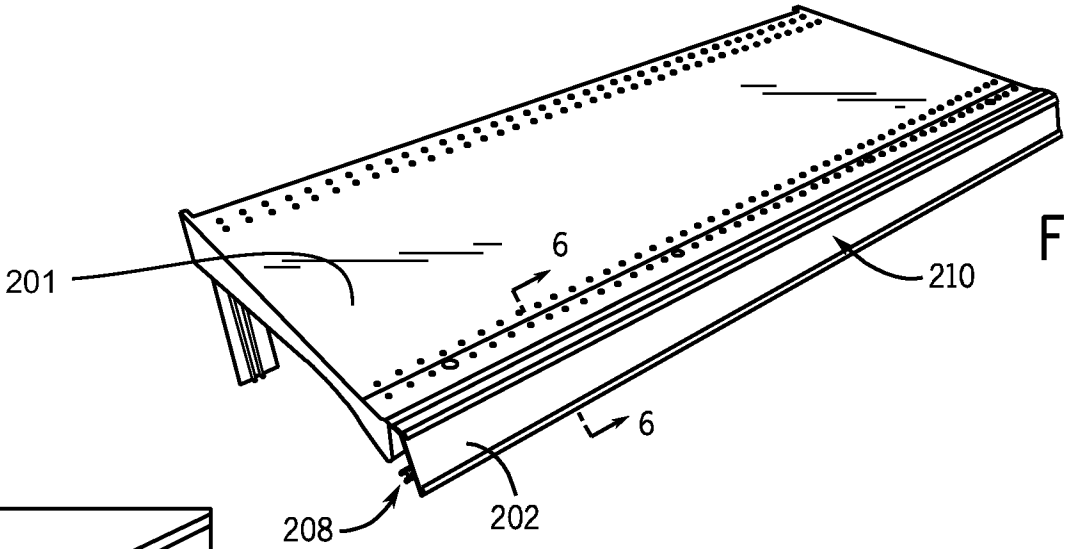
FIG. 4 is a perspective view of a shelf of the shelving system of FIG. 3.
Figure 6:
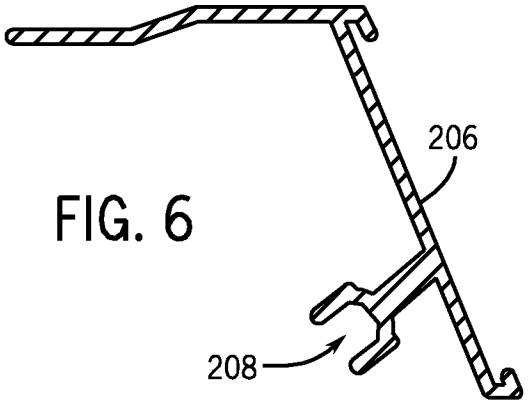
FIG. 6 is a section view of a lamp bracket in accordance with the shelving system of FIG. 3, taken generally along the line 6-6 in FIG. 4.
Figure 5:
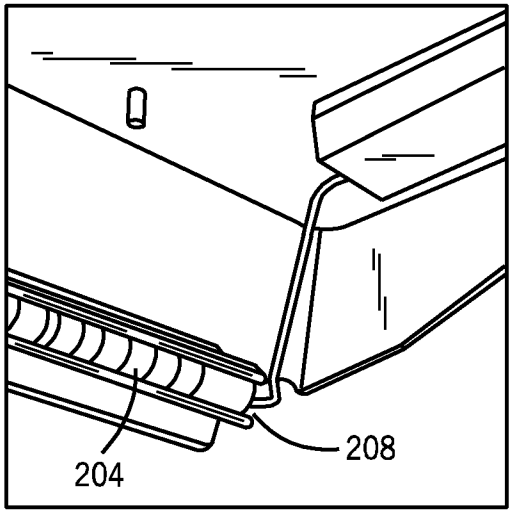
FIG. 5 is a detail perspective view of the shelf of FIG. 4, showing the underside detail of the shelf.

FIG. 2 is another perspective view of the illuminated shelving system of FIG. 1. FIG. 2 shows in greater detail how the lighting components themselves are interconnected. A light strip 104 is connected to a power strip 110 by a light strip power cord 105 and a plug 108. As shown, the shelving system 100 includes a low voltage lighting system incorporating Light Emitting Diode ("LED") lighting elements, including the power strip 110, which is a low voltage power strip such that individual plugs are not necessary. Of course, other power strips may be used without departing from the invention. The power cord 105 and plug 108 may be separate components as shown in FIG. 2, or may be created as a single component.

As shown, the power strip 110 is a continuous channel that provides much greater flexibility in terms of where the plug 108 is connected to the power strip 110 than a conventional electrical socket. Such flexibility allows the retailer to position the shelves 102 as desired without concern for where the plug 108 nay be connected to the power strip 110. The plug 108 shown in the present embodiment is a "Twist and Lock" type, but other types may be used without departing from the invention. A cable channel 106 that guides the light strip power cord 105 from the light strip 104 to the power strip 110 is attached to the underside of each shelf 102 by double sided tape 114. Other fastening means may also be used without departing from the invention.

FIGS. 3-6 are perspective views of another embodiment of an illuminated shelving system 200 in accordance with the invention. Electrically, the embodiment illustrated in FIGS. 1-2 and the present embodiment are identical. Rather than attaching the light bar 104 directly to the underside of each shelf 102, however, the embodiment illustrated in FIGS. 3-6 includes a bracket 202 that is attached to the front edge of an existing shelf 201. The bracket 202 includes mounts 208 for attaching the light strip 204, which is electrically attached to a power strip 210. The bracket 202 may be made of extruded plastic that allows some of the light to illuminate price labels attached to the front of the bracket 206.

Although the invention has been herein described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein.

What is claimed is:

1. An illuminated shelving system comprising: at least one shelf having top and bottom surfaces, front and rear portions and being removably attached to a shelf support that supports the shelf in a horizontal position; at least one light bar having a first and second end, the light bar extending about a width of the shelf and being attached to the front portion of the bottom surface of the shelf; a power cable having a first and second end with the first power cable end connected to the first end of the light bar and having an electrical plug connected to the second power cable end; a cable channel attached to the bottom surface of the shelf and extending from the front portion of the shelf toward the rear portion of the shelf with at least a portion of the power cable disposed within the channel to enclose the at least a portion of the power cable; and a continuous power strip attached to the shelf support to which the plug is removably attached at any location along the continuous power strip to supply power to the light bar from the power strip, wherein the electrical plug is a low voltage twist and lock type plug; and the power strip comprises a continuous channel oriented vertically along the shelf support in order to allow the shelf to be positioned as desired with respect to the shelf support without concern for where the plug is connected in relation to the power strip; wherein the electrical plug is insertable into the power strip at any location along the channel to receive power and rotatable between a first position to electrically connect the light bar to the power strip and a second position to electrically disconnect the light bar from the power strip and wherein the power strip has first and second conductors positioned opposite one another along the length of the channel, wherein upon rotating the electrical plug within the power strip, terminals located on the electrical plug are electrically engaged with the first and second conductors of the power strip.

2. The illuminated shelving system of claim 1 wherein the at least one light bar comprises removably attachable low voltage light emitting diodes and the power strip comprises a low voltage power strip.

3. The illuminated shelving system of claim 1 wherein the at least one light bar comprises at least one of a halogen, fluorescent, or incandescent lamp.

4. An illuminated shelving system comprising: at least one shelf having top and bottom surfaces, front and rear portions, and the shelf being removably attached to a shelf support that supports the shelf in a horizontal position; a light bar support bracket removably attached to the front portion of the at least one shelf, the light bar support bracket having a first and second surface; a light bar having a first and second end, the light bar extending about a width of the shelf and being removably attached to the second surface of the light bar support bracket; a power cable connected to the first end of the light bar, the power cable further including an electrical plug; a cable channel extending a length generally perpendicular to the light bar, the channel being attached to the bottom surface of the shelf to enclose a portion of the power cable; and a continuous channel power strip attached to the shelf support; wherein the plug is removably attachable to the continuous channel power strip at any location between opposing ends thereof, wherein the electrical plug is a low voltage twist and lock type plug; and the continuous channel power strip comprises a U-shaped continuous channel oriented vertically along the shelf support in order to allow the at least one shelf to be positioned as desired with respect to the shelf support without concern for where the plug is connected in relation to the continuous channel power strip, wherein the electrical plug is insertable into the power strip at any location along the channel to receive power and moveable between a first position to electrically and mechanically connect the plug to the continuous channel power strip and a second position to electrically and mechanically disconnect the plug from the continuous channel power strip, and wherein the power strip further comprises first and second electrical conductors positioned within and running along a longitudinal length of the continuous channel wherein upon rotating the electrical plug within the power strip, terminals located within the electrical plug are electrically engaged with the first and second conductors.

5. The illuminated shelving system of claim 4 wherein the at least one light bar comprises an array of light emitting diodes.

6. The illuminated shelving system of claim 4 wherein the at least one light bar comprises a fluorescent tube.

7. The illuminated shelving system of claim 1 further comprising a plurality of light bars positioned along the front of the bottom surface of a plurality of shelves spaced between a top and bottom portion of the shelf support, wherein the plurality of light bars are connected to a common power source.

8. The illuminated shelving system of claim 1 wherein the light bar support bracket is configured to receive price labels on the first surface of the light bar support bracket and wherein the at least one light bar is removably attached to the second surface of the light bar support bracket.

9. The illuminated shelving system of claim 1, wherein the light bar is removably attached to the front of the bottom surface of the shelf by at least one of an adhesive, hook and loop fastener, and a bracket.

10. An illuminated system comprising: at least one lighting strip; at least one power cable connected to the at least one lighting strip on a first end and connected to a power strip via an electrical plug on a second end; a cord channel defining a recess within which at least a portion of the power cable is disposed to enclose the at least a portion of the power cable, the lighting strip and cord channel having respective fasteners, wherein the lighting strip and cord channel are attached to an underside of a shelf; a continuous power strip into which the electrical plug is capable of being inserted at any position there along in order to allow the lighting strip to be positioned as desired; and a main power cord for powering the continuous power strip and indirectly the at least one lighting strip wherein the continuous power strip comprises a pair of electrical conductors located on separate sides of the continuous power strip and running longitudinally along the continuous power strip so that the electrical plug is capable of being inserted into the continuous power strip at any longitudinal location of the continuous power strip, and wherein the cable channel is moveable between an open position and a closed position so that the power cable encloses a portion of the power cable and releasably connects the power cable to the shelf, the cable channel having a first portion moveable with respect to a second portion, the first portion moveable between an open position wherein an inner cavity of the cable channel is exposed so that the power cable may be inserted into or removed from the cable channel and a closed position wherein the inner cavity of the cable channel is circumferentially enclosed by the cable channel, the first portion having a curved lip to make insertion and removal of the power cable into and out of the cable channel, respectively, more easily accomplished.

11. The illuminated system of claim 10, wherein the at least one lighting strip and the at least one power cable comprises a plurality of lighting strips and respective power cables with each lighting strip connected to respective power cables on respective first power cable ends and a plurality of respective electrical plugs connected to respective second power cable ends, wherein the respective electrical plugs connect to the continuous power strip to power the plurality of lighting elements and the main power cord remains a single power cord to power the continuous power strip and indirectly each of the plurality of lighting strips from a common power source.

12. The illuminated system of claim 11, further comprising at least one shelf having top and bottom surfaces, the at least one shelf being removably attached to a shelf support that supports the at least one shelf in a horizontal position.

13. The illuminated system of claim 12, wherein the at least one shelf comprises a plurality of shelves spaced apart from one another and between a top and bottom portion of the shelf support and wherein the plurality of lighting elements are each removably attachable to respective bottom surfaces of the plurality of shelves.

14. The illuminated system of claim 13, wherein the plurality of lighting elements are removably attached to the front of the bottom surface of the shelf by at least one of an adhesive, hook and loop fastener, and a bracket.

15. The illuminated system of claim 12, wherein the continuous power strip is coupled to the shelf support.

16. The illuminated system of claim 15, wherein the connector rotatably inserts into the continuous power strip.

17. The illuminated shelving system of claim 1, wherein the cable channel encloses a portion of the power cable and releasably connects the power cable to the shelving system, the cable channel having a first portion moveable with respect to a second portion between a first position wherein an inner cavity of the cable channel is exposed so that the power cable may be inserted into or removed from the cable channel and a second position wherein the inner cavity of the cable channel is circumferentially enclosed by the cable channel.

18. The illuminated shelving system of claim 4, wherein the at least one shelf having top and bottom surfaces comprises a plurality of shelves each having top and bottom surfaces, front and rear portions, and the plurality of shelves being removably attached to the shelf support that supports the plurality of shelves in a horizontal position; the light bar support, light bar, power cable and cable channel comprising a plurality of light bar supports, light bars, power cables and cable channels each connected to a respective shelf, each cable channel enclosing a respective power cable and releasably connecting the respective power cable to the respective shelf, each cable channel having a first portion moveable with respect to a second portion, the first portion moveable between an open position wherein an inner cavity of the cable channel is exposed so that the power cable may be inserted into or removed from the cable channel and a closed position wherein the inner cavity of the cable channel is circumferentially enclosed by the cable channel, the first portion having a curved lip to make insertion and removal of the power cable into and out of the cable channel, respectively, more easily accomplished.

19. The illumination system of claim 10, wherein the at least one lighting strip, power cable and cord channel comprises a plurality of lighting strips, power cables and cord channels with a first lighting strip, power cable and cord channel grouping extending from a first portion of the continuous power strip for connection to a first shelving unit, and a second lighting strip, power cable and cord channel grouping extending from a second portion of the continuous power strip, different from the first portion, for connection to a second shelving unit, the continuous power strip defining a U-shaped channel with conductors connected to separate sides of the U-shaped channel and running a longitudinal length of the continuous power strip, the first and second lighting strip, power cable and cord channel groupings being operably connectable to the power strip continuously along the longitudinal length of the U-shaped channel and connectable to a common power source via the main power cord of the illuminated system.

* * * * *